US005357943A

United States Patent [19]

Edgerton

[11] Patent Number: 5,357,943

[45] Date of Patent: Oct. 25, 1994

[54] SHIELD ASSEMBLY

[76] Inventor: Billy J. Edgerton, 6218 Beach Bayou Rd., Biloxi, Miss. 39532

[21] Appl. No.: 107,084

[22] Filed: Aug. 17, 1993

[51] Int. Cl.[5] ..... F24H 3/00

[52] U.S. Cl. ..... 126/214 D; 126/211; 126/214 R; 126/42

[58] Field of Search ..... 126/211, 214 R, 201, 126/42, 214 D

[56] References Cited

U.S. PATENT DOCUMENTS 3,789,823 2/1974 Doskocil ..... 126/42
4,155,343 5/1979 Hartman .
4,157,705 6/1979 Canan .
4,517,955 5/1985 Ehrlich et al. .
4,964,393 10/1990 Knudsen .

FOREIGN PATENT DOCUMENTS 2626064 7/1989 France .

*Primary Examiner*—Larry Jones
*Attorney, Agent, or Firm*—Arter & Hadden

[57] ABSTRACT

A shield assembly is disclosed for use with a stove, which comprises a stove top with a work surface, a heating mechanism disposed on the horizontal top surface and at least one control knob affixed to the work front surface. The shield assembly comprises a shield made of a material transparent to visible radiation, and a mechanism affixed to the shield assembly for releasably securing the shield assembly to the vertical front surface at a point intermediate the control knob and the heating mechanism.

17 Claims, 3 Drawing Sheets

SHIELD ASSEMBLY

FIELD OF THE INVENTION

This invention relates to oven or stove shields. In particular, it relates to oven shields that prevent spills, that occur on the stove top, from reaching the oven control knobs, handle and the surrounding surfaces.

BACKGROUND OF THE INVENTION

Several types of oven shields are currently available. The problems facing these shields with regards to protecting the oven knobs from spills and debris are: the ability to easily remove the device from the stove or oven for cleaning, the intended location of the shield on the stove or oven, and the materials from which the previous shields are made.

The French patent 2626-064-A to Panieri discloses the use of a safety panel for a different application, namely to prevent small children from touching the stove burners or cooking utensils, which are disposed on the top, horizontal surface of an oven. The shield is affixed with a complex mounting assembly comprised of threaded hooks or catches. The intended use of the panel is to protect small children from touching the cooking surface or the control knobs; thus, the panel is preferably affixed below the oven knobs. The use of Panieri's safety panel would not prevent debris coming from the stove top from reaching the control knobs and handle of his oven.

U.S. Pat. No. 4,964,393 to Knudsen discloses the use of a protective shield for an oven that is also designed to prevent small children from burning themselves. Knudsen discloses that his shield is attached on the top of the oven door by an "L" shaped bracket that is fastened to the oven by screws, thus making the shield difficult to remove for cleaning. When mounted to an oven, Knudsen's shield is perpendicular to the surface of the stove top.

It is, by contrast to these patents, proposed by this invention to protect the oven control knobs and handles from spills that occur on the stove top. Knobs and handles have hard to reach surfaces and are difficult to clean. A shield needs to prevent debris and food substances from reaching such surfaces. Indicia (letters and numbering) are disposed on the oven knobs and are often removed by repeated washings. A shield also needs to be easily and quickly removed and re-installed on the oven. Further, the shield should permit a cook to readily view the control knobs when the shield is installed.

The following patents are characteristic of the present state of this field. U.S. Pat. No. 4,517,955 to Ehrlich discloses the use of barrier system that attaches to the oven by detachable hinges. U.S. Pat. No. 4,157,705 to Caan is a "U"-shaped guard attached to the top of the stove by brackets.

SUMMARY OF THE INVENTION

It is therefore an object of this invention to provide a new and improved shield for use with a stove to prevent food from spilling over from the stove top onto the control knobs and other surfaces on the stove front.

It is a further object of this invention to provide a new and improved shield which is easily mounted and removed from a stove.

It is a still further object of this invention to provide a new and improved shield which may be easily washed.

In accordance with these and other objects of this invention, a shield assembly is disclosed for use with a stove, which comprises a work surface, a heating mechanism disposed on the work surface, and at least one control knob affixed to the work surface. The shield assembly comprises a shield made of a material transparent to visible radiation, and a mechanism affixed to the shield assembly for releasably securing the shield assembly to the work surface at a point intermediate the control knob and the heating mechanism to overlie and shield the control knob from the spatter of food being cooked on the heating mechanism.

In one aspect of this invention, the shield assembly is adapted for a stove, which includes a slot disposed through the work surface. The shield assembly further includes a substantially flat mounting member of a configuration conforming substantially to that of the slot and of dimensions such that the mounting member may be readily inserted into the slot and retained therein.

In a further aspect of this invention, the shield assembly comprises a mounting member affixed to the shield and at least one magnet affixed to the mounting member for releasably securing the shield assembly to the work surface.

BRIEF DESCRIPTION OF THE DRAWINGS

A written description setting forth the best mode presently contemplated for carrying out the present invention, and of the manner for implementing and using it, is provided below with respect to the following drawings.

DETAILED DESCRIPTION OF THE PREFERRED EMBODIMENT

Figure 1:
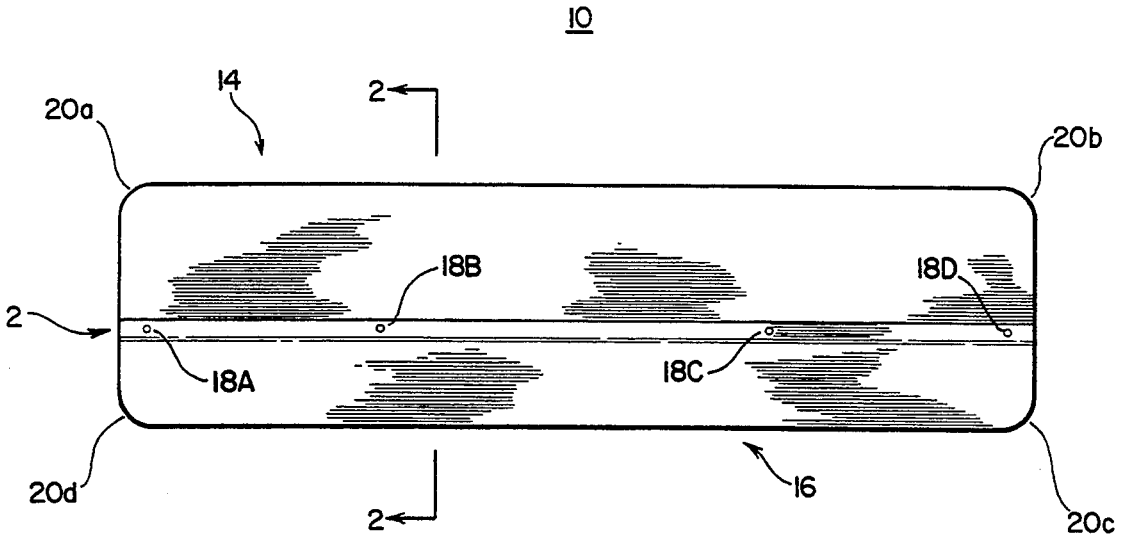
FIG. 1 is a top, plan view of a shield assembly in accordance with the teachings of this invention.

Referring now to the drawings and in particular to FIG. 1, the preferred form of a shield assembly 10 is shown as comprising a transparent shield 14, a mounting member 16, and a connecting mechanism 12, which connects the transparent shield 14 and the mounting member 16 together. The shield assembly 10 has rounded edges 20 *a, b, c* and *d*. The transparent shield 14 is a flat member made of a heat resistent, polycarbonate plastic such as "Tuffak-A" or glass such as "Pyrex". A shield 14 of "Tuffak-A Polycarbonate Sheet" may be used at temperatures as high as 270° F. The transparent shield 14 has a plurality of large rivet openings 28 *a, b, c* and *d*, which are disposed in a line adjacent to and parallel with its bottom most edge of the transparent shield 14, as shown in FIG. 1. The mounting member 16 is made of a durable, lightweight metal such as aluminum or stainless steal. The mounting member 16 includes a mounting tongue 23, which is substantially flat, a support portion 25, and a connecting portion 22, which is disposed between and interconnects the tongue 23 and the support portion 25. The connecting mechanism 12 comprises a plurality of rivets 18 that are disposed in a line adjacent to and parallel with the top most edge of the mounting member 16, as seen in FIG. 1. Each of the rivets 18 comprises, as shown in FIG. 2B, a head 19 and a shank 21. The rivets 18 are made of a durable metal, illustratively brass.

Figure 2A:
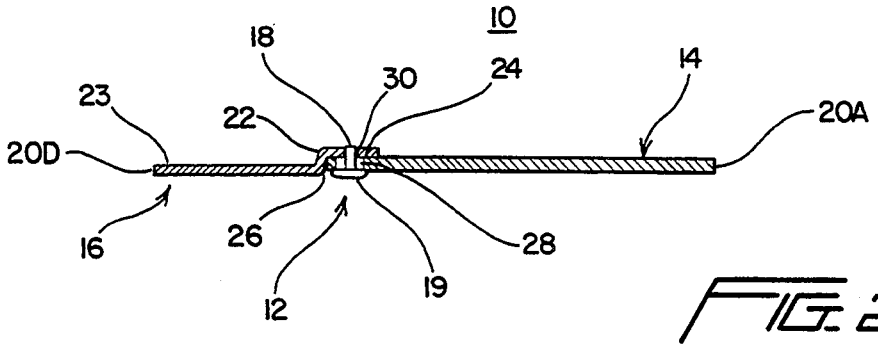
FIG. 2A is a side, cross-sectioned view of the shield assembly with a mounting member, as taken along line 2—2 of FIG. 1.
Figure 2B:
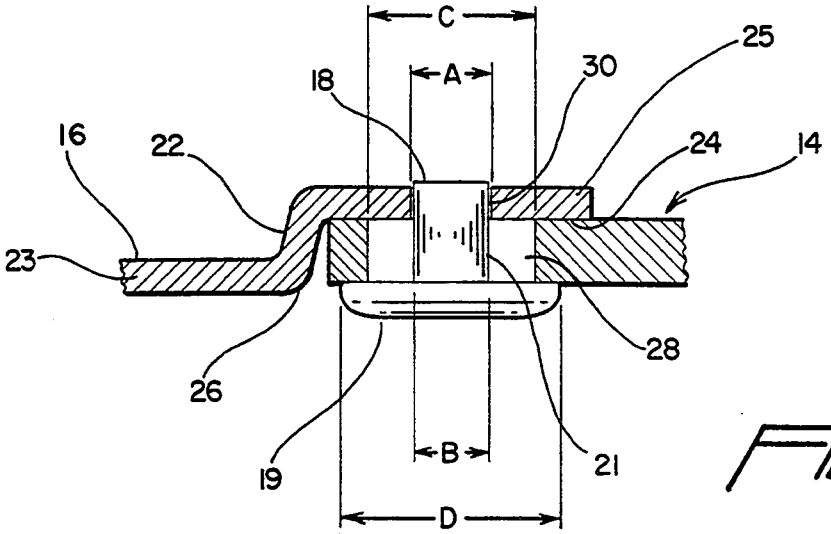
FIG. 2B is an enlarged side, cross-sectioned view of the rivet and surrounding portion of the shield assembly as seen in FIG. 2A.

As seen in FIG. 2A, the connecting mechanism 12 joins the transparent shield 14 and the mounting member 16. Now referring to FIG. 2B, the support area 25 includes a support surface 24. The connecting portion of the shield 22 presents a shield butt surface 26. The support surface 24 and the shield butt surface 26 form a pocket for receiving and supporting an edge portion of the transparent shield 14. In particular, the bottom surface of the transparent shield 14 is held horizontally by the support area 25 of the mounting member 16.

As best shown in FIG. 2B, a first set of rivet openings 30 is formed in the mounting member 16, and a second set of large rivet openings 28 is formed in the transparent shield 14. The rivet openings 30 are spaced from each other and oriented to be aligned with the large rivet openings 28 of the transparent shield 14, when the transparent shield 14 is disposed over the mounting member 16, as best shown in FIG. 2B.

The transparent shield 14 and the mounting member 16 are fastened together by the plurality of rivets 18. The opening 28 through the transparent shield 14 has a diameter identified by the letter C, and the opening 30 through the mounting member 16 has a diameter A. As best seen in FIG. 2B, it is apparent that each of the aligned pairs of rivet openings 28 and 30 receives a rivet 18. The dimensions of the rivet 18 and the openings of 28 and 30 are carefully selected. The rivet head 19 has a diameter D and the rivet shank 21 has a diameter B. To secure the transparent shield 14 to the support surface 24, the diameter D of the rivet head 19 is made larger than the diameter of the rivet opening 28. The diameter A of the rivet shank 21 is set slightly less than the diameter B of the opening 30, whereby the shank 21 fits tightly within the opening 30.

The metal of which the rivets are made, e.g., brass or steel, has a coefficient of thermal expansion, which is greater than that of the plastic material of which the shield 16 is made, e.g., "Tuffak-A Polycarbonate Sheet". In particular, steel has a coefficient of 0.63, whereas "Tuffax-A Polycarbonate Sheet" has a coefficient of 3.80 In/In ° F. $10^{-5}$. Thus when heated, the metal used in the rivets 18 expands at a greater rate than the plastic or glass used in the transparent shield 14. To prevent the rivet shank 21 from breaking the transparent shield 14 when heated, the diameter C of the rivet opening 28 in the transparent shield 14 is made larger than the diameter B. In an illustrative embodiment of this invention, the diameter C is set equal to 2B, i.e., twice the shank diameter.

Figure 3:
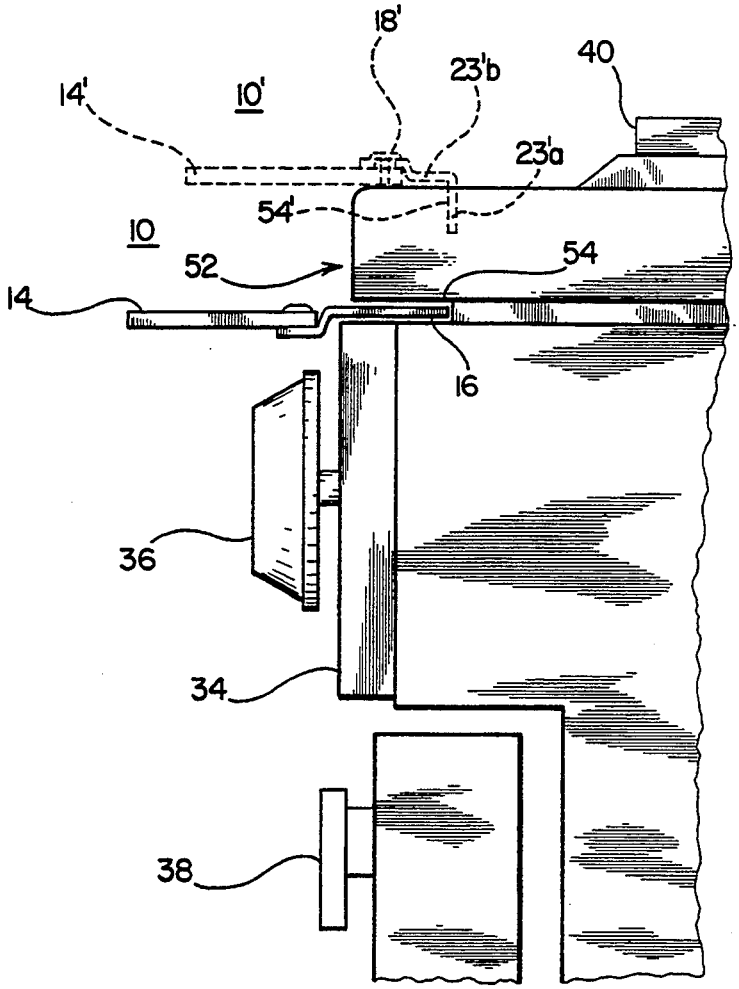
FIG. 3 is a side, elevational view of the shield assembly illustrating how it is used with a gas stove having a recessed grove therein.

As seen in FIG. 3, gas stoves typically have a slot 54 disposed between a horizontal stove top 32 and a vertical stove front 34. The mounting member 16 slides horizontally into the slot 54 of the stove 52 and thus the transparent shield 14 lies perpendicular to the stove front 34. The shield 14 is disposed between a burner 40 on the stove top 32 and all of the control knobs 36 and handles 38 affixed to the stove front 34. Thus, the assembly 10 prevents spills that occur on the stove top 32 from reaching the stove front 34, control knobs 36 and oven handle 38. Further the shield 14 is made of a transparent material, whereby a cook standing over the stove 52 may look downward as shown in FIG. 3 to readily observe the controls 36 and the handles 38.

To mount the shield assembly 10, one need only to insert the mounting member 16 horizontally into the slot 54 of a stove 52 as seen in FIG. 3. To remove the shield assembly 10 from the stove 52 for cleaning, the mounting member 16 is pulled horizontally out of the slot 54. Thus, the shield assembly 10 may be quickly removed, cleaned and re-installed.

Figure 2C:
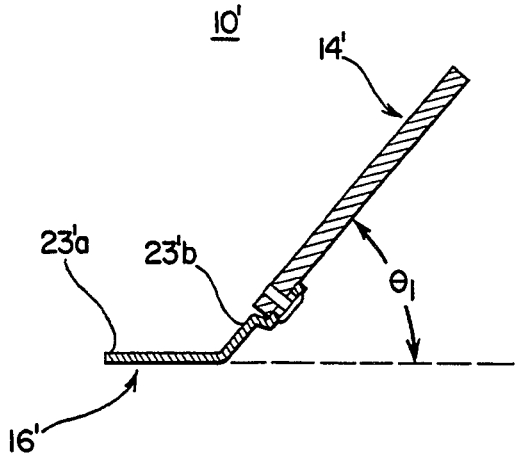
FIG. 2C is a side, cross-sectioned view of an alternative embodiment of this invention.

Referring now to FIG. 2C, there is shown a further embodiment of the shield assembly, where similar elements are identified by like numbers, but distinguished by a'. The shield assembly 10' has a mounting member 16' including a mounting tongue 23' divided into a first portion 23'a and 23'b. The portions 23'a and 23'a are essentially flat plate like elements, which are connected at an angle with respect to each other of $\theta_1$. It is contemplated that the tongue portion 23'a could be inserted into the slot 54 as illustrated in FIG. 3. In such an embodiment, the angle $\theta_1$ would be set at a value of 30° to 45°, whereby the transparent shield 14' would be disposed at a similar angle with respect to ground and between the control knobs 36 and the food being cooked on the burners 40. In a further embodiment as shown in FIG. 3, a slot 54' could be disposed within the stove top 32 and the angle 81 be set at 90°, whereby the tongue portion 23'b and the transparent shield 14' would extend parallel to the stove top 32 and to the ground below.

Figure 4:
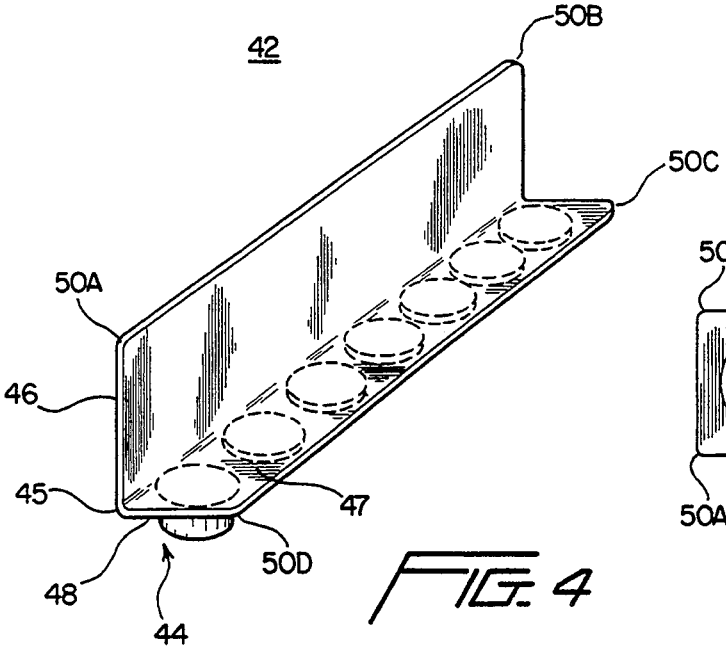
FIG. 4 is a perspective view of a further embodiment of this invention in the form of a shield with a magnetic mounting assembly.
Figure 5:
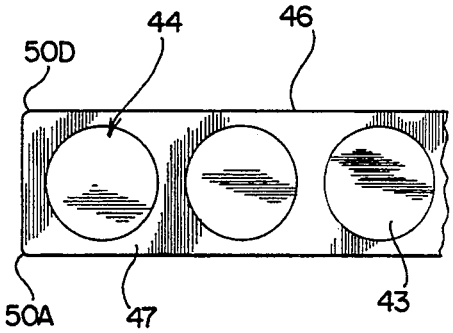
FIG. 5 is a bottom view of the shield and its magnetic mounting assembly, as shown in FIG. 4.
Figure 6:
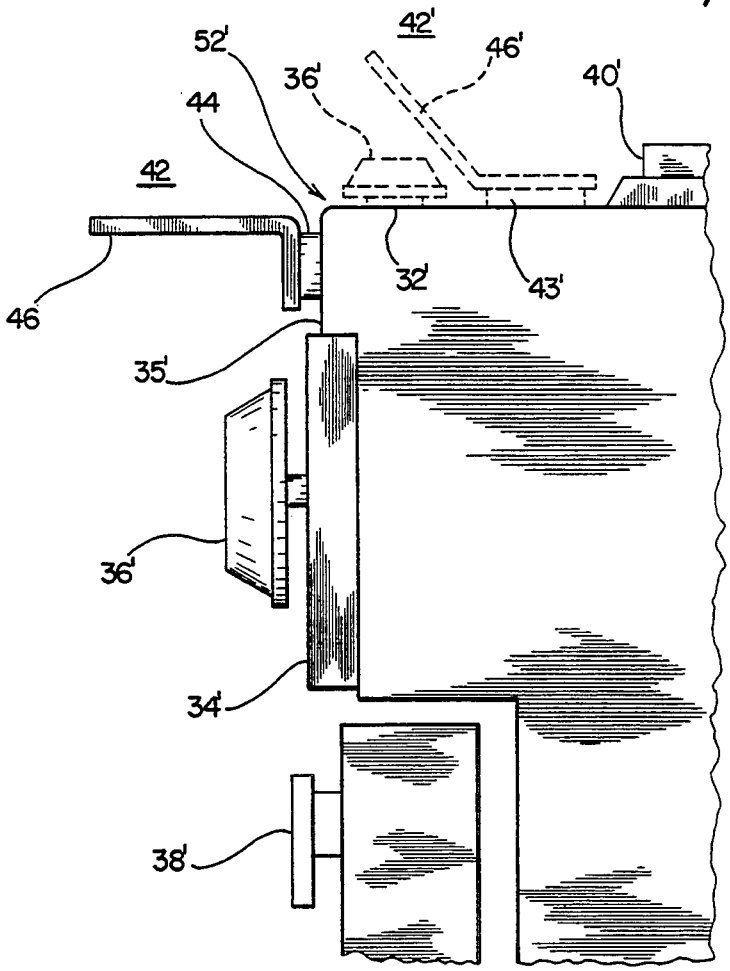
FIG. 6 is a side, elevational view of the shield of FIG. 4 with a magnetic mounting assembly as it is used with a conventional electrical stove having an essentially flat front surface.

A further embodiment of this invention is illustrated in FIGS. 4, 5 and 6. A magnetic shield assembly 44 takes the shape of an L-shaped member as shown in FIG. 4, and comprises a transparent shield portion 46, a bend 45 and a magnetic mounting portion 48, which comprises a mounting surface 47. A plurality of magnets 43 are secured to the mounting surface 47. As seen in FIGS. 4 and 5, the magnetic shield assembly 42 has rounded edges 50 A, B, C and D. The transparent shield portion 46 is mounted perpendicularly to the mounting surface 47 by the bend 45 to form an L-shape. The mounting surface 47 is attached to the magnets 43 by an adhesive 48 such as contact cement, lamination, or other heat resistent adhesives, e.g., "Super Glue" or "Weldwood" contact cement.

The magnetic shield assembly 42 addresses the problems of protecting the control knobs 36 and oven handle 38 from spills. Electric stoves 52' often do not have a slot 54, as shown in FIG. 3. The magnetic shield assembly 42 is attached by a magnetic mounting assembly 44 as seen in FIG. 4 to the stove 52' with or with out a slot. The magnetic mounting assembly 44 is mountable on the stove front 34' and, in particular, to a substantially flat surface 35' presented thereby so that the transparent shield 46 is oriented in a horizontal relation to the floor and perpendicular to the stove front surface 35'.

To use the magnetic shield assembly 42, one places the magnetic mounting assembly 44 against the surface of the stove front 34' as seen in FIG. 6. To remove magnetic shield assembly 42 from the stove 52' for cleaning, the shield 44 is simply pulled off of the stove front surface 35' and washed with a suitable detergent before being remounted.

Figure 7:
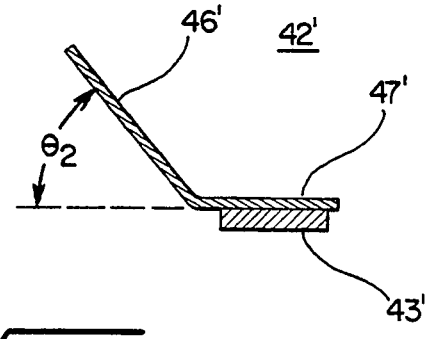
FIG. 7 is a side, cross-sectioned view of an alternative embodiment of this invention.

Referring now to FIG. 7, there is shown a further embodiment of a magnetic shield assembly, where similar elements are identified with like numbers but distinguished by a ' e g., the assembly of FIG. 7 is identified by the numeral 42'. The magnetic assembly has the mounting surface 47' for receiving a plurality of the magnets 43' and a transparent shield 46'. As shown in FIG. 7, the transparent shield 46' is oriented at an angle $\theta_2$ with respect to the plane of the mounting surface 47'. In contrast to the mounting of the L-shaped magnetic shield assembly 42 on the front surface 35' of the stove front 34' the magnetic shield assembly 42' is adapted as shown by the dotted line in FIG. 6 to be used with a set of control knobs 36'' which are mounted on the front edge of the stove top 32'. In particular, the magnets 43' would serve to releasably attach the magnetic shield assembly 42' to the stove top 32' so that its transparent shield 46' overlies and protects the control knobs 36''. The transparent shield 46' is set at an angle $\theta_2$ with respect to the mounting surface 47' in the range of 15°–45°, whereby the transparent shield 46' further shields the control knobs 36'' and permits access by the user from the front of the stove 52'.

In considering this invention, it should be remembered that the present disclosure is illustrative and the scope of the invention should be determined by the appended claims.

I claim:

1. A shield assembly for use with a stove, which comprises a work surface, heating means disposed on the work surface, at least one control knob disposed on the work surface and a slot disposed through the work surface and into the stove for receiving said shield assembly, the slot being disposed intermediate the control knob and the heating means, said shield assembly comprising:

a) a shield of generally flat configuration and being made of a material transparent to visible radiation;

b) a mounting member of a configuration conforming substantially to that of the slot and of dimensions such that said mounting member may be inserted readily into the slot and retained therein; and c) means for attaching said shield to said mounting member, whereby said shield is disposed intermediate the heating means and the control knob to overlie and to shield the control knob from spatter of food being cooked on the heater means, said attaching means made of a material which retains its structural integrity in the presence of the heat emanating from the heating means.

2. The shield assembly of claim 1, wherein said mounting member and shield are made respectively of materials with different coefficients of thermal expansion, and securing means comprises means for compensating for said different coefficients without damage to said shield.

3. The shield assembly of claim 2, wherein each of said shield and said mounting member comprise respectively first and second pluralities of openings therethrough, one opening of said first plurality being aligned with an opening from said second plurality, and securing means includes a plurality of fasteners, each being inserted through a pair of said aligned openings.

4. The shield assembly of claim 3, wherein each of said fasteners has a shank of a first, outside diameter and each of said openings of said shield has a second, inside diameter, said second diameter being greater than said first diameter.

5. The shield assembly of claim 4, wherein said second diameter is twice the length of said first diameter.

6. The shield assembly of claim 1, wherein said mounting member comprises a substantially flat tongue portion for insertion into the stove slot, a substantially flat support portion and a portion interconnecting said tongue portion and said support portion in an offset relation, whereby said tongue portion and said support portion lie in respective planes offset from each other, said tongue portion and said support portion forming a pocket for receiving said shield.

7. The shield assembly of claim 6, wherein said shield and said support portion comprise respectively first and second pluralities of openings therethrough, each opening of said first plurality being aligned with a corresponding opening of said second plurality, said securing means comprising a plurality of fasteners, each being inserted through a pair of said aligned openings.

8. The shield assembly of claim 1, wherein the work surface includes a top horizontal surface and a front vertical surface, the slot being disposed through the top, horizontal surface, said attaching means attaching said shield at a substantially right angle to said mounting member, whereby said shield is disposed perpendicular to the front vertical surface.

9. The shield assembly of claim 1, wherein the work surface comprises a top, horizontal surface and a front vertical surface, the slot being disposed through the front vertical surface, whereby said attaching means supports said shield in a perpendicular relationship to the front vertical surface.

10. A shield assembly for use with a stove, which comprises a work surface extending to a front of the stove, heating means disposed on a top surface and at least one control knob disposed on the work surface, said shield assembly comprising:

a) a shield of generally flat configuration and being made of a material transparent to visible radiation;

b) a mounting member attached to said shield at an angle; and c) means attached to said mounting member for releasably securing said shield assembly to the work surface at a point intermediate the heating means and the control knob to orient said shield at said angle with respect to the work surface to overlie and to shield the control knob from the spatter of the food being cooked on the heater means and to permit ready access to the one control knob from the front of the stove.

11. The shield assembly of claim 10, wherein said securing means comprises at least one member made of a magnetic material.

12. The shield assembly of claim 11, wherein said shield and said mounting member are made integrally of a single member of a transparent, plastic material, and said magnetic member is secured by an adhesive to the mounting member.

13. The shield assembly of claim 10, wherein the work surface comprises a top, horizontal surface and a front, vertical substantially flat surface, said angle being selected to be substantially 90°, whereby said shield extends substantially perpendicular to the front surface.

14. The shield assembly of claim 10, wherein the work surface is a top, horizontal surface and the control knob is disposed on the top, horizontal surface, said angle being selected to the less than 90° and said securing means securing said shield assembly to the top, horizontal surface at a point intermediate the control knob and the heater means, whereby said shield extends over the control knob while permitting a user access to the control knob from the front of the stove.

15. A shield assembly for use with a stove which comprises in combination:

a) a work surface, said work surface comprising a top, horizontal surface and a front vertical surface;

b) heating means disposed on said horizontal top surface; and c) at least one control knob affixed to said vertical front surface;

d) said shield assembly comprising a shield made of a material transparent to visible radiation, and means affixed to said shield assembly for releasably securing said shield assembly to said work front surface at a point intermediate said control knob and said heating means.

16. The combination of claim 15, wherein said stove further includes a slot disposed through said work surface at said point and said shield assembly further includes a substantially flat mounting member of a configuration conforming substantially to that of said slot and of dimensions such that said mounting member may be readily inserted into said slot and retained therein.

17. The combination of claim 15, wherein said shield assembly comprises a mounting member affixed to said shield and magnetic means affixed to said mounting member for releasably securing said shield assembly to said vertical front surface at said point.

* * * * *